United States Patent [19]

Weaver

[11] 4,169,293

[45] Oct. 2, 1979

[54] HYDROTHERAPY VESSEL LEVEL CONTROL

[75] Inventor: Albert E. Weaver, Van Nuys, Calif.

[73] Assignee: Chanso Corporation, Las Vegas, Nev.

[21] Appl. No.: 876,027

[22] Filed: Feb. 8, 1978

[51] Int. Cl.[2] ..... A47K 3/10; A47K 3/00; A61H 33/02

[52] U.S. Cl. ..... 4/178; 4/180; 4/181

[58] Field of Search ..... 4/173, 178, 213, 180, 4/181

[56] References Cited

U.S. PATENT DOCUMENTS

| | | | |
|---|---|---|---|
| 3,374,492 | 3/1968 | Ruderian | 4/178 |
| 3,441,015 | 4/1969 | Oatman et al. | 4/178 |
| 3,614,952 | 10/1971 | Agnellino | 4/178 |
| 3,939,506 | 2/1976 | Pearson | 4/213 |

*Primary Examiner*—Henry K. Artis
*Attorney, Agent, or Firm*—Seiler & Quirk

[57] ABSTRACT

A liquid level control system for a hydrotherapy vessel has a pressure sensing device located in the vessel. The pressure sensing device activates a switch which shuts off the hydrotherapy pump when the water in the vessel drops below a predetermined level.

7 Claims, 3 Drawing Figures

HYDROTHERAPY VESSEL LEVEL CONTROL

BACKGROUND OF THE INVENTION

In recent years, hydrotherapy vessels have become increasingly popular for both medical and social usage. In the past, the use of hydrotherapy vessels (sometimes known as "Jacuzzis") was generally limited to medical or physical therapy purposes; for example, athletes having muscle strains would commonly be subjected to hydrotherapy to relieve pain and increase circulation, thereby facilitating recovery. In recent years, the use of hydrotherapy vessels for social purposes and relaxation has undergone spectacular growth, particularly in the Western United States. Units may be located outdoors, either in conjunction with a swimming pool, or independently. These units are usually relatively large, holding from 150 to about 800 gallons, and chemicals for modifying water pH and controlling growth of bacteria are added similarly to the treatment of swimming pools.

A new type of hydrotherapy vessel is a bathtub equipped with water circulating mechanisms. These bathtubs are intended for use indoors, and are sufficiently small to justify filling for each use. These bathtubs are generally molded shells having jet nozzles located at various points on the interior of the tub. A circulating pump brings water from a location near the tub bottom and pumps it through the jets, thereby creating desired turbulence. Air intake ports built into the jet permit air to be sucked into the jet in large quantities according to the Bernouilli effect, creating a large volume of fluid flow. In preparing these hydrotherapy tubs, the user first fills the tub to the desired level with water. He then turns the pump on with a switch that is commonly mounted on a wall timer, and then steps into the tub. Ordinarily, the timer shuts the pump off automatically while the user is still in the tub; otherwise the user shuts it off by hand upon leaving the tub.

Problems have been encountered where the therapy tub user is inexperienced and unfamiliar with the operation of the tub, or when the user is forgetful. If the user does not turn the pump off before emptying the tub, extensive damage can occur. As the tub empties, the water level drops below that of some of the water jets, resulting in a stream of water being sprayed with great force outside of the tub. Hotels have experienced substantial damage to wallpaper and other fixtures as a result of the water pump being left on as the tub is emptied. In addition, when the water drains to a level below the pump suction, the pump will run dry and burn out. Similar major damage to the pump will result if the pump is inadvertently turned on when there is no desire or intent to fill the tub with water, such as where a child turns on the switch.

Several efforts have been made to preclude room or pump damage caused by leaving the water pump on as the tub empties. The use of timers having very short cycles is unacceptable because the user must get out of the tub to reset the timer. In most areas, building codes require that the electrical switch be located at a defined minimum distance from the tub. Float-operated level controls, which turn off the pump mechanically, have been unsuccessful because they are somewhat bulky, and because the floats tend to stick and become inoperable in a relatively short period of time because of deposits caused by the alkalinity of the water. In addition, the floats cannot be located in the user portion of the tub, and must be hidden in an enclosed area.

Accordingly, it is an object of the invention to provide a liquid level controlling system for a hydrotherapy tub which will automatically shut the water pump off when the water in the tub reaches a certain level. It is another object of the invention to provide a hydrotherapy tub liquid level control system which is easy to install, inexpensive, and virtually maintenance free. It is a still further object of the invention to provide a liquid level controller which does not change the shape of a hydrotherapy tub, and does not detract from the appearance of the tub. These and other objects of the invention will become apparent through the following detailed description of the invention.

SUMMARY OF THE INVENTION

In a hydrotherapy vessel system having a vessel, a water pump, nozzle means located in a wall of the vessel, conduit means for circulating water from the vessel back to the vessel through the nozzle means, and switch means for actuating the water pump, the improvement therein which comprises level control means comprising pressure sensing means mounted in a vessel wall, switch means coupled to said pressure sensing means for turning the water pump off when the water level decreases to a predetermined height, and electrical conduit means for connecting the switch means to the water pump.

BRIEF DESCRIPTION OF THE DRAWINGS

The invention is better understood with reference to the drawings in which.

DETAILED DESCRIPTION OF THE INVENTION

Figure 1:
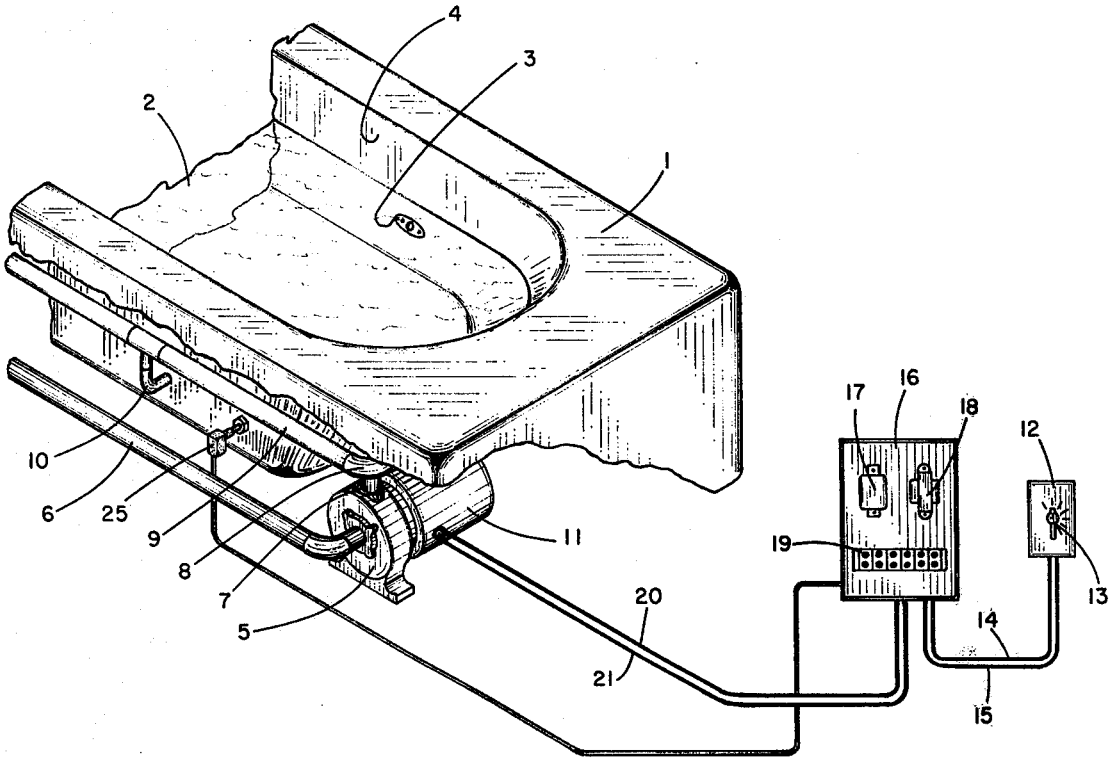
FIG. 1 is a partial perspective view of a therapy tub, cut away to show the pump and piping.

Referring to FIG. 1, hydrotherapy tub 1 is a molded shell, which may be fiberglass, cast iron, tile, acrylic, or the like, having a water-holding portion 2. The hydrotherapy system comprises a series of jets or nozzles 3 located at various points in the side wall 4 of the tub at a level of from about 4" to about 10", preferably from about 6" to about 8", above the floor of the tub, and pump 5 which circulates water from the tub through the jets. Water travels from the tub through a side-mounted suction fitting (not shown) to the pump through pump suction line 6, which is copper or PVC pipe of diameter as required to accommodate desired water flow (usually ½–2"). The pump is a conventional ¾ to 2 horsepower centrifugal pump, an example of which is Model No. AQ10, 1 HP pump manufactured by "Aqua-Flo". Pump outlet 7 is connected with a tee fitting 8 to conduit 9, which is also copper or PVC pipe, and which carries the water under force to individual smaller pipes 10 leading to the jets. The hydrotherapy system is a closed loop system, and is conventional in the art.

Figure 3:
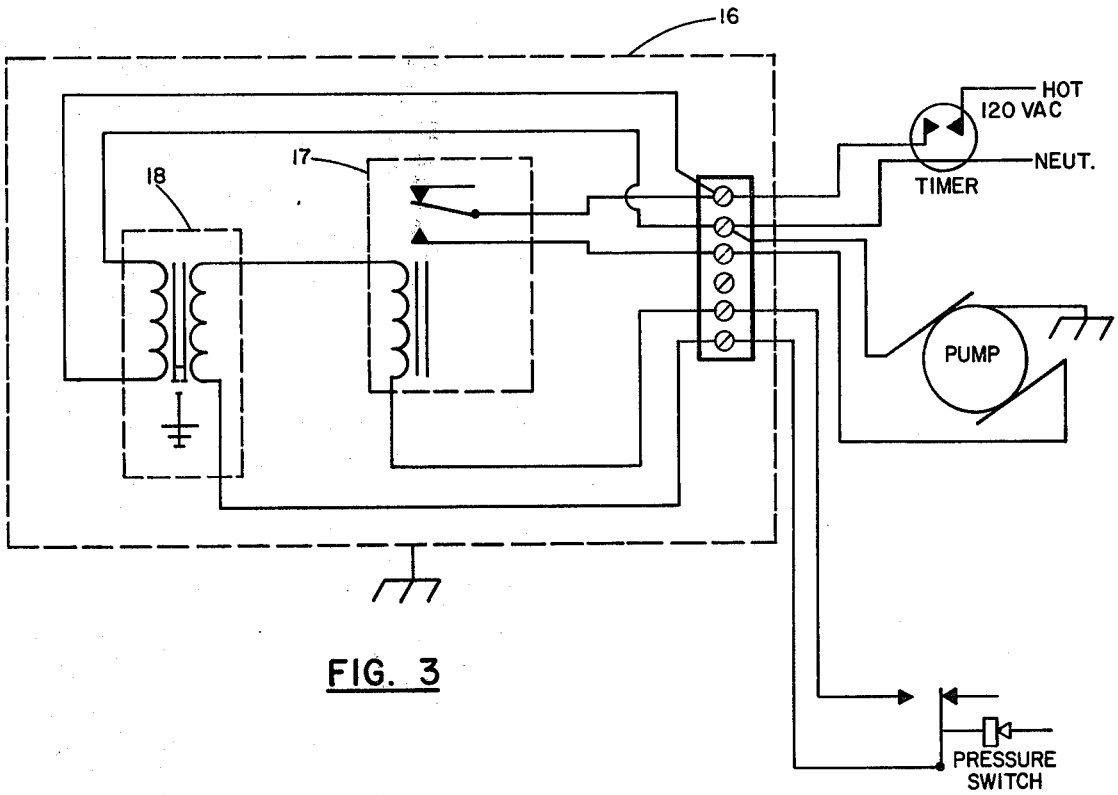
FIG. 3 is an electrical circuit diagram.

Operation of the pump is controlled by timer switch 12 which can be set for any desired length of operating time by moving the pointer on switch 13 to the desired number of minutes shown on the surface of the timer. The timer is connected electrically, by wires 14 and 15, to circuit box 16, which contains relay switch 17, transformer 18, and terminal bar 19. Details of the electrical wiring of the system are shown in FIGS. 3 and 4. Electrical wires 20 and 21 connect pump motor 11 to the circuit box.

Figure 2:
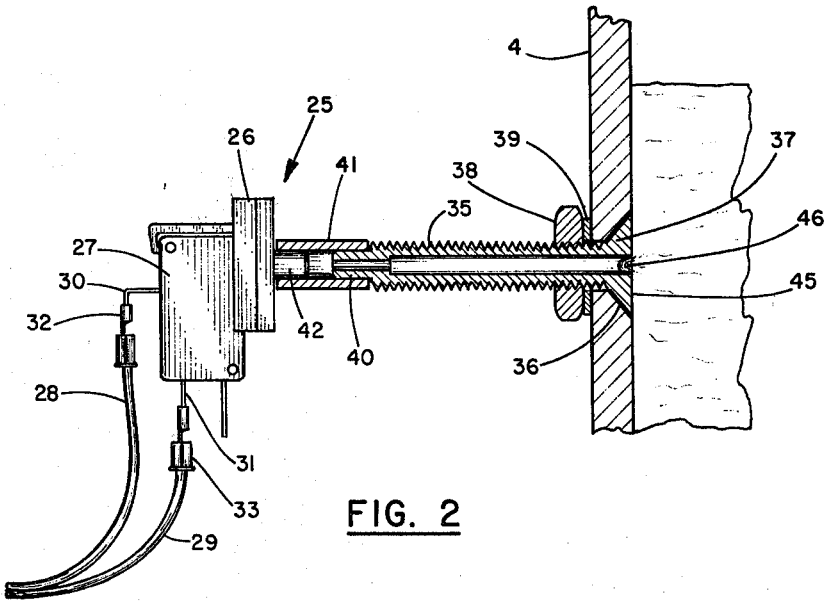
FIG. 2 is an elevational section view of the pressure sensing device.

The low pressure switching system 25 is most easily understood with reference to FIG. 2. Pressure switch 25 comprises pressure actuator assembly 26, which contains a sensitive diaphragm, and switch portion 27. Pressure on the diaphram is transferred to the switch by a column of air which mechanically closes the switch contact. The switch is wired in the normally open position. The switch is conventional; a commercially available example is the Ultra Low Pressure Switch, Model PSF 103A, manufactured by Fairchild Industrial Products of Commack, N.Y. This particular switch is actuated when the height of the water column above the switch is about 2.0 inches. The switch is rated at 3 amps, 120 v AC; however, in this application 24 v AC power is employed to eliminate risk of electrical shock to tub users. The switch is wired in low-voltage (24 v AC) circuitry to the control box through wires 28 and 29 attached to terminals 30 and 31 with clip contacts 32 and 33.

The mounting of the pressure switch in the tub is very important to proper operation of the system. The liquid level fitting 35 is a 2" long brass screw having a central axial bore throughout its length. The fitting extends through the wall 4 of the tub from the inside, with orifice 36 in the tub wall being shaped to fit the screw head 37. The fitting is mounted in the tub at approximately the level of the highest return jet of the hydrotherapy system. A silicone sealer adhesive is placed between the head of the screw and the wall to insure against leakage. The bolt is fastened to the wall by nut 38 and lock washer 39. The end ¼" of the shaft of the screw, designated in FIG. 2 as 40, is machined smooth to a diameter of about 0.167" to enable connection with a short piece of flexible Tygon tubing 41. This tubing connects the liquid level fitting to the nipple 42 on the pressure switch.

The face of the bolt 45 mounts flush with the inside wall of the tub and therefore is not noticed by the tub user. The bore in the screw has a diameter of ⅛", decreasing to 1/16" near the end of the screw. The diameter of the bore is very critical, especially at the orifice adjacent to the tub wall; a large diameter would enable water to flow into the bore, resulting in the accumulation of deposits from evaporation of the water over a period of time. In addition, water remaining inside the level sensor after the tub is drained creates an unsanitary condition, could encourage the growth of harmful bacteria, and would also cause deterioration of the switch. It has been found that this opening should be no greater than about 3/16", and is preferably from about 1/16" to ⅛", more preferably is about ⅛". An orifice of less than about 1/16" is unsatisfactory because of the possibility of plugging with small particles; an orifice greater than about 3/16" will cause water to remain in the tube. With a bore opening of about ⅛" diameter, the water only enters the tube a short distance in the form of a meniscus 46 as shown in FIG. 2. When the tub is emptied, the water is drawn out of the tube by surface tension, and no water remains in the bore.

The internal wiring of the circuit box is shown in FIG. 3. According to FIG. 3, 120 v AC house current is directly connected to the primary coil of transformer 18 through the timer. The secondary coil, which generates 24 v AC, is connected to the relay coil through the pressure switch. Both the pressure switch and relay are wired in the normally open position. When the pressure switch is closed by the water level in the tub, current flows to the relay coil and closes the relay switch, thereby providing 120 v power to the pump.

In operation, the system is very simple. When the timer switch is in the "on" position, the pump will operate only when the level of water in the tub is about 2" over the level sensor. If the tub drain is opened, or if the water level decreases suddenly when the user leaves the tub, the pressure switch will automatically shut the pump off. The pressure switch will close as soon as the tub is refilled to the proper level. Under no circumstances can the pump operate unless the timer switch is on. Operation is automatic and maintenance-free, and does not require a reservoir of water outside the tub as is necessary for float-controlled operation. The sensing device does not protrude into the tub and therefore is not noticed by the user.

The location of the liquid level sensor is very important to proper operation of the system of the invention. It is desired to control the level of the water at a safe level, preferably at least ½" above the highest jet. This will preclude water from spraying out of the jet and into the surrounding area as the water level drops below the jet level. The sensor is preferably located in the sidewall of the tub, away from any turbulence and pressure variations which would be caused by filling the tub. While the actual height of placement in the tub will depend upon the sensitivity of the pressure sensor, it is desirable to maintain a level in the tub at least ½" and preferably 2" above the height of the highest jet.

The size of the particular vessel used is not critical, but is generally less than 250 gallons, and usually between 30 and 100 gallons. The important feature of the vessel is that it is intended for single-filling usage; i.e., the tub is emptied after each use.

While a specific mode of the invention has been described in detail herein, many alternatives and modifications within the scope and spirit of the invention will be apparent to those skilled in the art. The essence of the invention relates to the use of a pressure sensitive switch to actuate and shut off the pump with varying water levels in the tub, and variations in vessel shape and size, circuitry, or water circulating system should not restrict the scope of the invention. Accordingly, the invention should be limited only by the following claims.

I claim:

1. In a hydrotherapy system having a walled vessel, a water circulating pump, conduit means for conducting water from the vessel to the pump, and back to the vessel, and switch means for actuating the water pump, the improvement therein which comprises safety switch means for automatically shutting off the pump when the water level is below a predetermined level in the vessel comprising pressure sensing means located in a vessel wall below the operating water level in the vessel and responsive to the water level in the vessel, switch means coupled to the pressure sensing means for interrupting electrical current to the pump, and electrical circuit means for connecting the switch means to the pump.

2. The improvement of claim 1 wherein the pressure sensing means comprises a hollow tube having an opening adjacent a wall of the vessel, the opening having a diameter of not greater than 3/16".

3. The improvement of claim 2 wherein the opening is about ⅛".

4. The improvement of claim 1 wherein the pressure sensing means comprises a hollow tube having an orifice of not more than 3/16" diameter, and the tube is mounted in the vessel wall with the orifice contiguous to an inner surface of the vessel walls.

5. The improvement of claim 1 wherein the electrical circuit means comprises a low voltage portion comprising a secondary transformer coil and the switch means, and a high voltage portion comprising a source of 120 v AC power, the pump, a primary transformer coil, and a relay switch actuated by current flow in the low voltage portion of the circuit.

6. The improvement of claim 1 wherein the pressure sensing means comprises a hollow tube having an orifice in the vessel sufficiently small such that water will not flow into the tube when the vessel is filled with water to a level above the tube, and pressure is transmitted to the switch means through a column of air in the tube.

7. The improvement of claim 6 wherein the orifice at one end of the tube is coplanar with a substantially vertical vessel wall.

* * * * *